US008429841B1

(12) United States Patent
Keller

(10) Patent No.: US 8,429,841 B1
(45) Date of Patent: Apr. 30, 2013

(54) TRAFFIC SAFETY SYSTEM

(76) Inventor: Butch Ernest J. Keller, Aztec, NM (US)

( * ) Notice: Subject to any disclaimer, the term of this patent is extended or adjusted under 35 U.S.C. 154(b) by 0 days.

(21) Appl. No.: 13/221,421

(22) Filed: Aug. 30, 2011

Related U.S. Application Data

(60) Provisional application No. 61/378,914, filed on Aug. 31, 2010, provisional application No. 61/429,166, filed on Jan. 2, 2011.

(51) Int. Cl.
*G09F 7/00* (2006.01)

(52) U.S. Cl.
USPC ..... 40/612

(58) Field of Classification Search ..... 40/612
See application file for complete search history.

(56) References Cited

U.S. PATENT DOCUMENTS

| | | | | |
|---|---|---|---|---|
| 5,094,023 | A * | 3/1992 | McVey | 40/607.04 |
| 5,422,638 | A * | 6/1995 | Singer et al. | 340/908.1 |
| 5,725,186 | A * | 3/1998 | Hillstrom et al. | 248/176.1 |
| 6,052,067 | A * | 4/2000 | Nuxoll | 340/908 |
| 6,115,951 | A * | 9/2000 | Jing et al. | 40/610 |
| 7,365,640 | B2 * | 4/2008 | Garcia | 340/431 |
| 2008/0197668 | A1 * | 8/2008 | Allovio | 296/181.1 |
| 2009/0237271 | A1 * | 9/2009 | Sundstrom | 340/936 |
| 2011/0010974 | A1 * | 1/2011 | White | 40/606.02 |

FOREIGN PATENT DOCUMENTS

| | | | |
|---|---|---|---|
| GB | 2118908 | A * | 11/1983 |
| GB | 2245402 | A * | 1/1992 |

* cited by examiner

*Primary Examiner* — Joanne Silbermann
*Assistant Examiner* — Kristina Junge

(57) ABSTRACT

A portable and solar powered traffic safety system functioning like a decoy police car. The system features a display panel with a picture of a police car and a light component with red and blue lights. The display panel is mounted on a solar panel frame atop a base and is held in place by a securing means. The base features legs each with a ballast to help support the base and prevent the system from tipping due to high winds. The system of the present invention can be used in a variety of locations, for example in rural or urban settings, residential areas, hospitals, schools, and construction zones.

14 Claims, 7 Drawing Sheets

(In-use View)

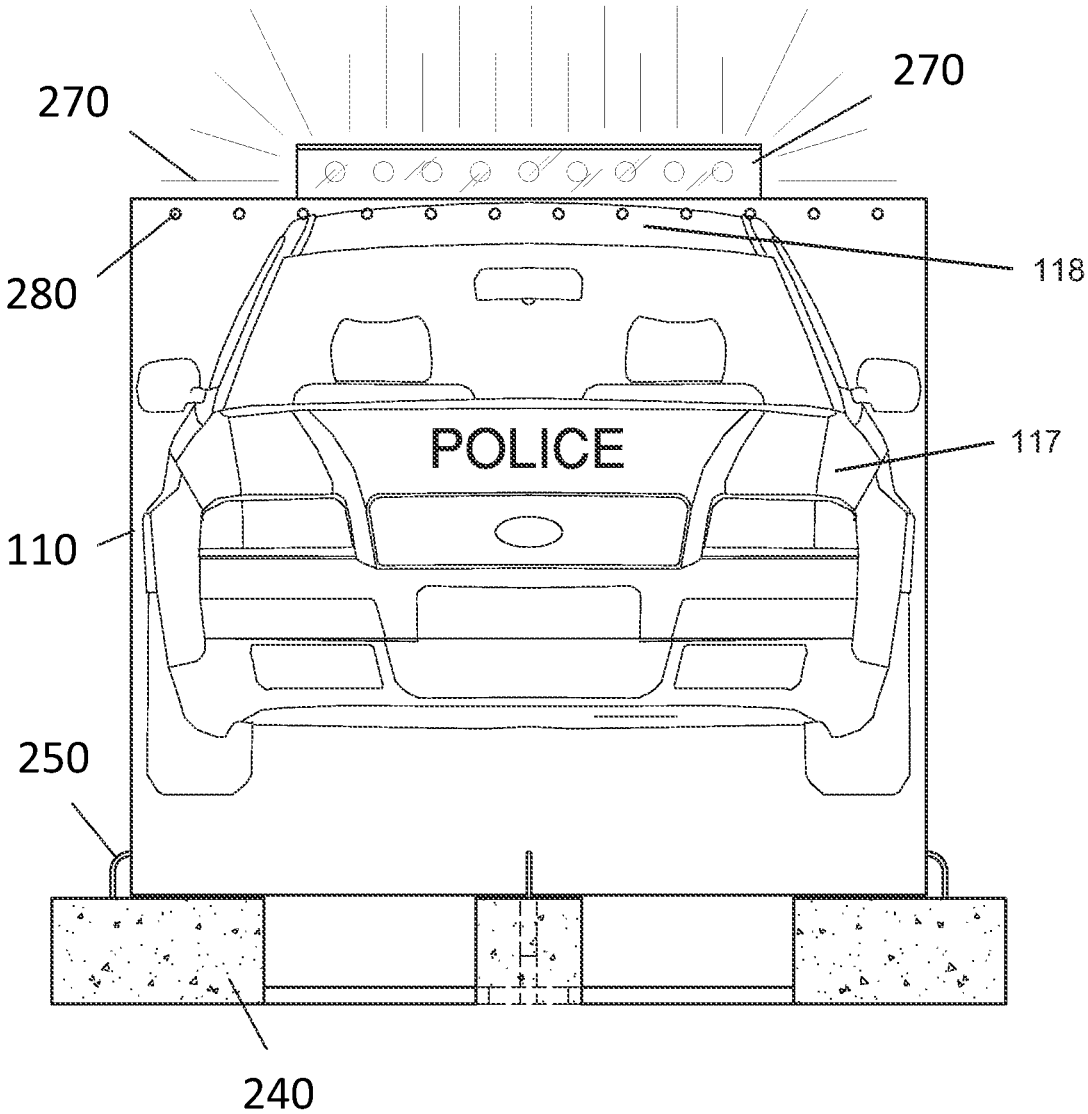
FIG. 3
(Front View)
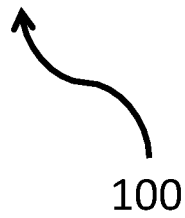

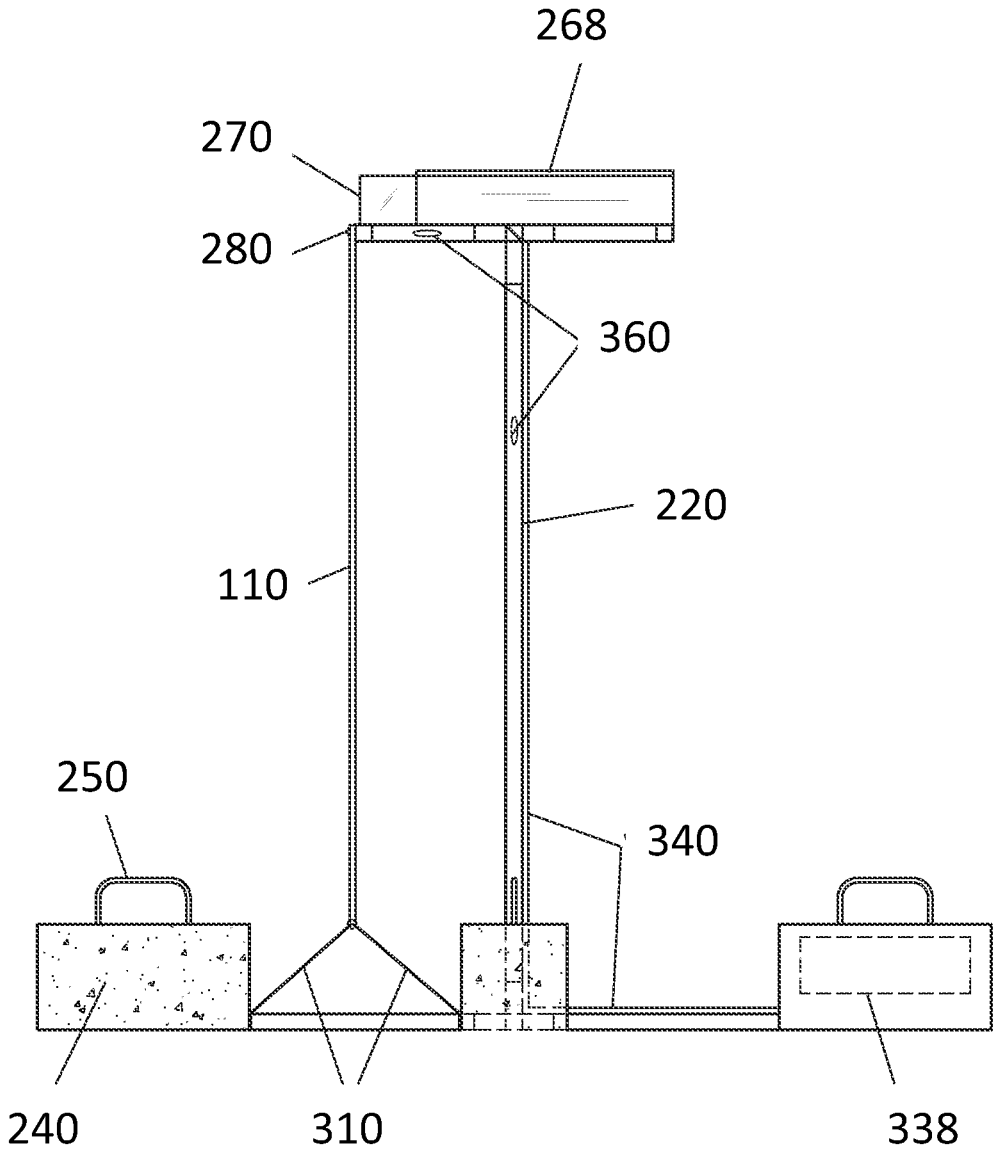
FIG. 4
(Side View)
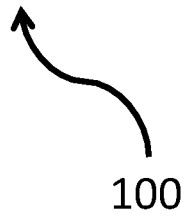

(Top View)

(Bottom View)

(Detail View)

TRAFFIC SAFETY SYSTEM

CROSS REFERENCE

This application claims priority to U.S. provisional application Ser. No. 61/378,914 filed Aug. 31, 2010 and U.S. provisional application Ser. No. 61/429,166 filed Jan. 2, 2011, the specifications of which are incorporated herein by reference in their entirety.

FIELD OF THE INVENTION

The present invention is directed to traffic safety and speed devices, more particularly to a solar powered and portable system designed to resemble a police car or emergency vehicle with the internationally accepted red and blue emergency lights.

BACKGROUND OF THE INVENTION

Many systems, such as standard radar systems used by police officers, are in use for attempting to control traffic. The present invention features a novel traffic safety system, which may be used in areas where there is concern for traffic safety and speed control. The system of the present invention comprises a decoy police car or emergency vehicle equipped with red and blue lights. The system is portable and is optionally solar powered. The system of the present invention may, for example, help reduce a high-speed motorist's speed on an open road from a large distance away. The system of the present invention can be used in a variety of scenarios, for example in rural or urban settings, residential areas, hospitals, schools, construction zones, etc. The system of the present invention can be supplemented with other speed-detection methods, such as laser detection or radar.

SUMMARY

The present invention features a traffic safety system. In some embodiments, the system comprises a display panel, wherein a picture of a police car is disposed on a front surface of the display panel; a base comprising a vertical shaft having a first end and a second end, and at least three legs extending outwardly from the second end of the vertical shaft, wherein a ballast is disposed on each free end of the legs; a solar panel frame disposed on the first end of the vertical shaft, the solar panel frame is adapted to hold a solar panel, wherein a top edge of the display panel is attached to a first side edge of the solar panel frame via a first attachment means; a light component disposed on the solar panel frame above the display panel, the light component comprises at least one light; a securing means attached to a bottom edge of the display panel and to at least one leg, the securing means helps hold the display in place; and a battery compartment housing a battery, the battery is operatively connected to the solar panels and to the light component, the battery is charged by the solar panels and supplies power to the light component.

In some embodiments, the legs are arranged symmetrically around the vertical shaft. In some embodiments, the ballast weighs about 50 pounds. In some embodiments, a handle is disposed on a ballast. In some embodiments, the ballasts are removably attached to the legs via a second attachment means. In some embodiments, the second attachment means comprises a strap mechanism, a magnet mechanism, a clamp mechanism, a hook mechanism, a tie mechanism, or a combination thereof.

In some embodiments, the first attachment means comprises a snap mechanism, a button mechanism, a magnet mechanism, a clamp mechanism, a clasp mechanism, a hook-and-loop fastener mechanism, a clip mechanism, a hook mechanism, a tie mechanism, or a combination thereof. In some embodiments, the light component comprises lights of two or more colors. In some embodiments, the securing means comprises a tie mechanism, a chain mechanism, a bungee mechanism, a clasp mechanism, a clip mechanism, a hook mechanism, or a combination thereof. In some embodiments, the battery compartment is disposed in a ballast.

In some embodiments, the system further comprises a securing mechanism for securing at least the vertical shaft and the solar panel frame together. In some embodiments, the securing mechanism comprises a cable lock. In some embodiments, a securing mechanism (e.g., cable lock) is disposed on the vertical shaft. In some embodiments, a securing mechanism (e.g., cable lock) is disposed on the solar panel frame. In some embodiments, a securing mechanism (e.g., cable lock) is disposed on the legs. In some embodiments, a securing mechanism (e.g., cable lock) is disposed on one or more ballasts. In some embodiments, a securing mechanism (e.g., cable lock) is disposed on the display.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 3 is a front view of the system of the present invention.

FIG. 4 is a side view of the system of the present invention.

DESCRIPTION OF PREFERRED EMBODIMENTS

Figure 1:
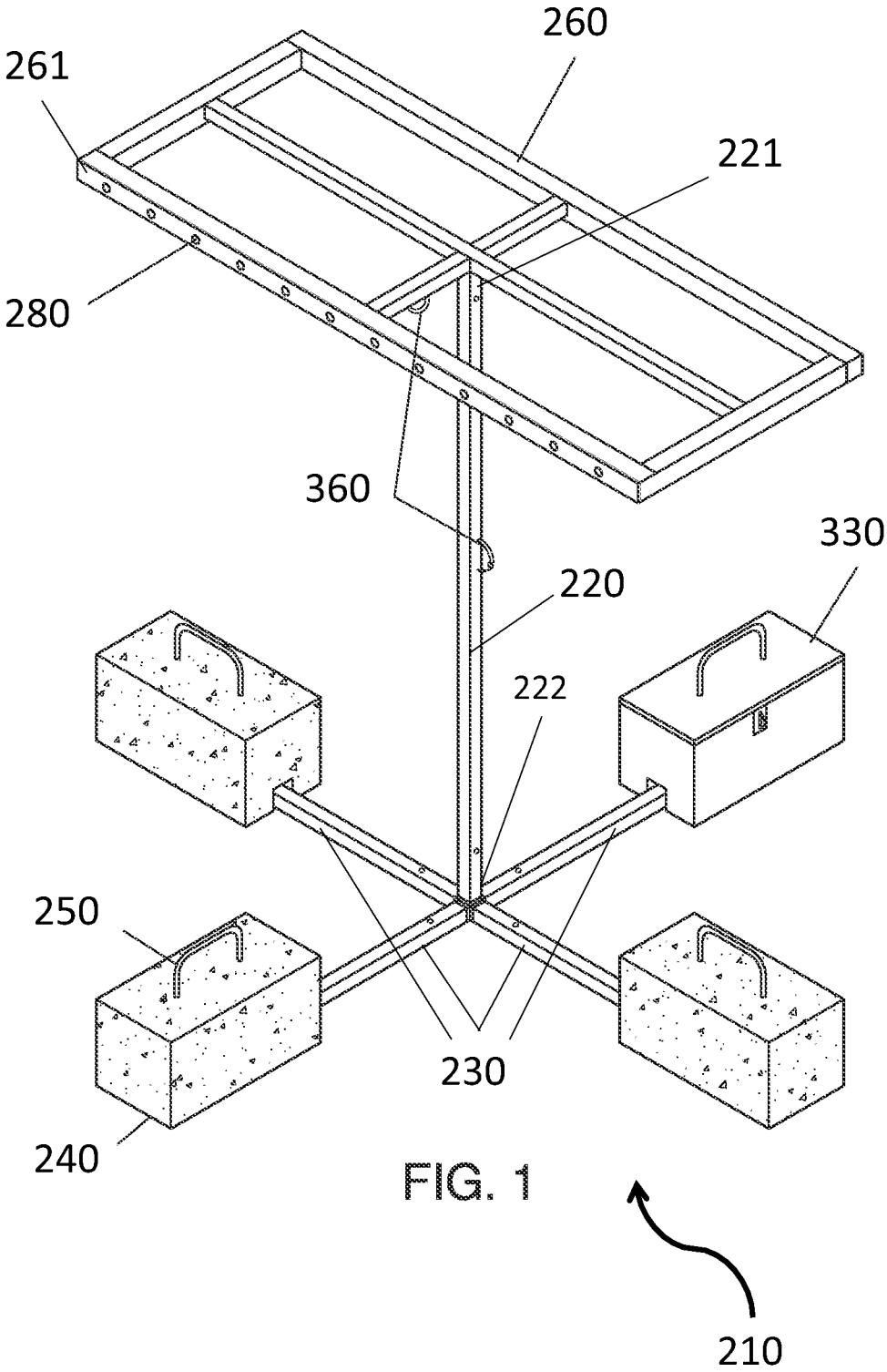
FIG. 1 is a perspective view of the base of the system of the present invention.

Referring now to FIGS. 1-7, the present invention features a novel traffic safety system 100. The system 100 of the present invention resembles a police car or emergency vehicle and serves as a decoy. In some embodiments, when the system 100 is activated, the system 100 (e.g., lighting) causes the driver to slow down, e.g., until the driver realizes the system 100 is a decoy. In some embodiments, the system 100 of the present invention is supplemented with a speed detection system, for example a radar system or a laser system. The present invention is in no way limited to the uses described herein. For example, in some embodiments, one or more components of the system 100 (e.g., the display panel 110 and light component 270) are attached or used in combination with a speed monitoring trailer or permanent radar mounts. Example 1 describes the system 100 of the present invention used in combination with a speed monitoring trailer.

The system 100 of the present invention comprises a display panel 110 (e.g., a banner) having a front surface 115 and a top edge 113. A picture is disposed on the front surface 115 of the display panel 110. In some embodiments, the picture is a photo overlay. In some embodiments, the display panel 110 is constructed from a material comprising vinyl. In some embodiments, the picture is of a police car 117 with a roof 118 or other emergency vehicle with the roof 118 of the police car adjacent to the top edge 116. The present invention is not limited to a police car. For example, in some embodiments, the picture is a word (e.g., "slow," "school," "hospital," "work zone," etc.) or other picture. In some embodiments, the display panel 110 appears three dimensional. In some embodiments, the display panel 110 further comprises reflectors.

The system 100 further comprises a base 210 on which the display panel 110 is mounted. The base 210 comprises a vertical shaft 220 having a first end 221 (e.g., top end) and a second end 222 (e.g., bottom end).

Extending from the second end 222 (or near the second end 222) is at least a first leg, a second leg, and a third leg. In some embodiments, a fourth leg also extends from the second end 222 of the vertical shaft 220. The legs 230 are adapted to help stabilize the vertical shaft 220, e.g., in an upright and vertical position as shown in FIG. 1. Each leg 230 has a shaft end 231 (attached to the vertical shaft 220) and a free end 232 that extends away from the shaft 220. In some embodiments, the legs 230 are arranged symmetrically around the vertical shaft 220.

Figure 6:
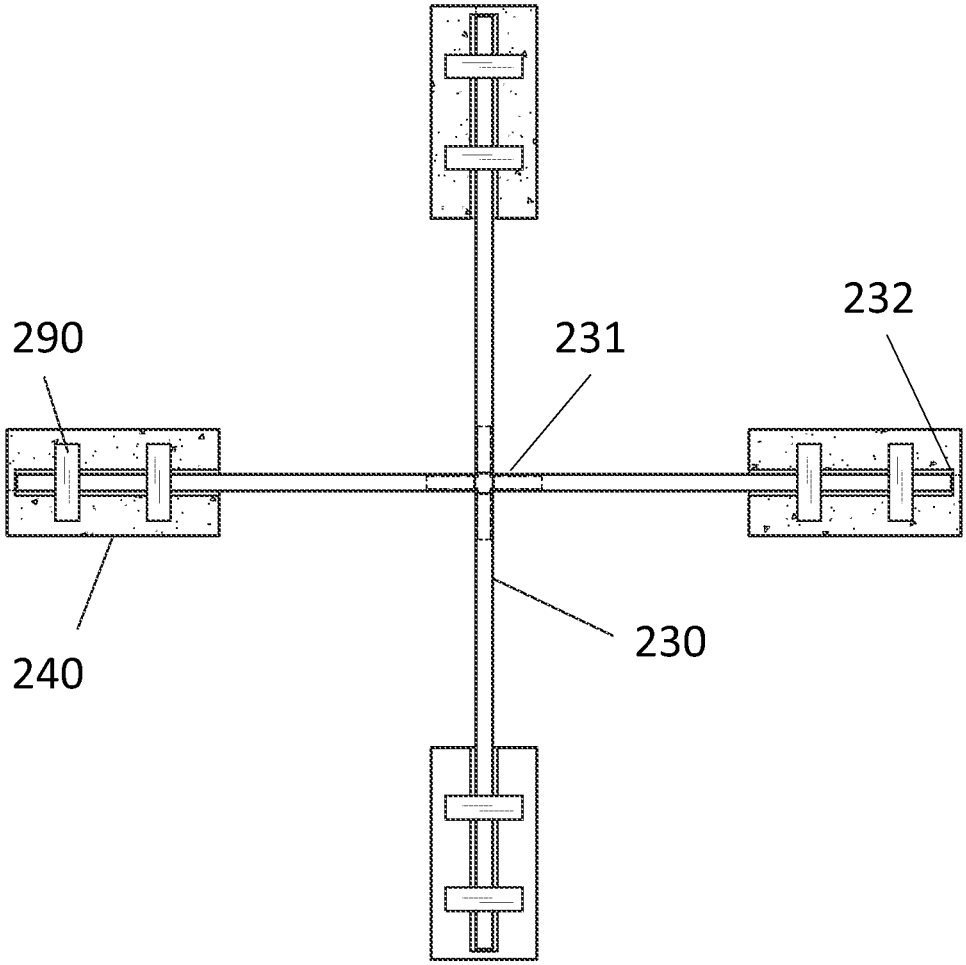
FIG. 6 is a bottom view of the system of the present invention.

In some embodiments, a ballast 240 (e.g., a concrete block) is disposed on the free end 232 of one or more of the legs 230. In some embodiments, a first ballast 241, a second ballast 242, a third ballast 243, and a fourth ballast 244 herein collectively referred to as a ballast 240 each comprises a groove 245 located on an underside of the ballast 240. In some embodiments, each ballast 240 is located on a free end 232 of one of the legs 230. In some embodiments, the free end (232) of each leg (230) fits into the groove 245) of the ballast (240) to hold the leg in place. The ballasts 240 help provide weight and stability to the legs 230 so that the system 100 can be secured in place and help prevent the system 100 from tipping, e.g., in high winds. In some embodiments, a handle 250 is disposed on one or more of the ballasts 240. The handle 250 allows the ballasts 240 to be lifted and transported. In some embodiments, the ballasts 240 are removably attached to the legs 230. For example, as shown in FIG. 6, the ballasts 240 may be removably attached to the legs 230 via a second attachment means. In some embodiments, the second attachment means comprises a strap mechanism (e.g., straps 290), a magnet mechanism, a clamp mechanism, a hook mechanism, a tie mechanism, the like, or a combination thereof.

In some embodiments, the ballast 240 weighs about 50 pounds. In some embodiments, the ballast 240 weights between about 20 to 30 pounds. In some embodiments, the ballast 240 weights between about 30 to 40 pounds. In some embodiments, the ballast 240 weights between about 40 to 50 pounds. In some embodiments, the ballast 240 weights between about 50 to 60 pounds. In some embodiments, the ballast 240 weights more than about 60 pounds. As used herein, the term "about" refers to plus or minus ten percent of the referenced number. For example, an embodiment wherein the ballast 240 weighs about 50 pounds includes a ballast 240 that weighs between 45 and 55 pounds.

Disposed on the first end 221 of the vertical shaft 220 is a frame 260 (e.g., solar panel frame). In some embodiments, the frame 260 is adapted to hold one or more solar panels 268, which are disposed flat on the frame (260). Solar panels are well known to one of ordinary skill in the art. The frame 260 may encompass any appropriate device mountable to the vertical shaft 220, wherein the frame 260 supports the display panel 110.

The display panel 110 attaches to the frame 260 (e.g., solar panel frame) via a first attachment means. For example, in some embodiments, a top edge 113 of the display panel 110 attaches to a first side edge 261 (e.g., front edge) of the frame 260. In some embodiments, the first attachment means comprises a snap mechanism 280, a button mechanism, a magnet mechanism, a clamp mechanism, a clasp mechanism, a hook-and-loop fastener mechanism, a clip mechanism, a hook mechanism, a tie mechanism, the like, or a combination thereof. As shown in FIG. 1, the first attachment means may secure the entire top edge 113 of the display panel 110 or a portion of the top edge 113 of the display panel 110.

Disposed on the frame 260 (e.g., solar panel frame), for example a top surface of the frame 260 (e.g., solar panel frame) above the display panel 110, is a light component 270. The light component 270 may comprise one or more lights, for example light emitting diodes (LEDs). The lights are not limited to LEDs. The light component 270 may comprise lights of one color or two or more colors (e.g., blue and red). As shown in FIG. 3, the light component 270 may resemble standard police car lights, which are well known to one of ordinary skill in the art. The light component 270 and the police car 117 on the front surface 115 form an integrated complete police car image with the light component positioned just above the roof of the police car.

In some embodiments, the light component 270 further comprises a speaker adapted to emit a sound, for example an emergency sound or siren.

Figure 2:
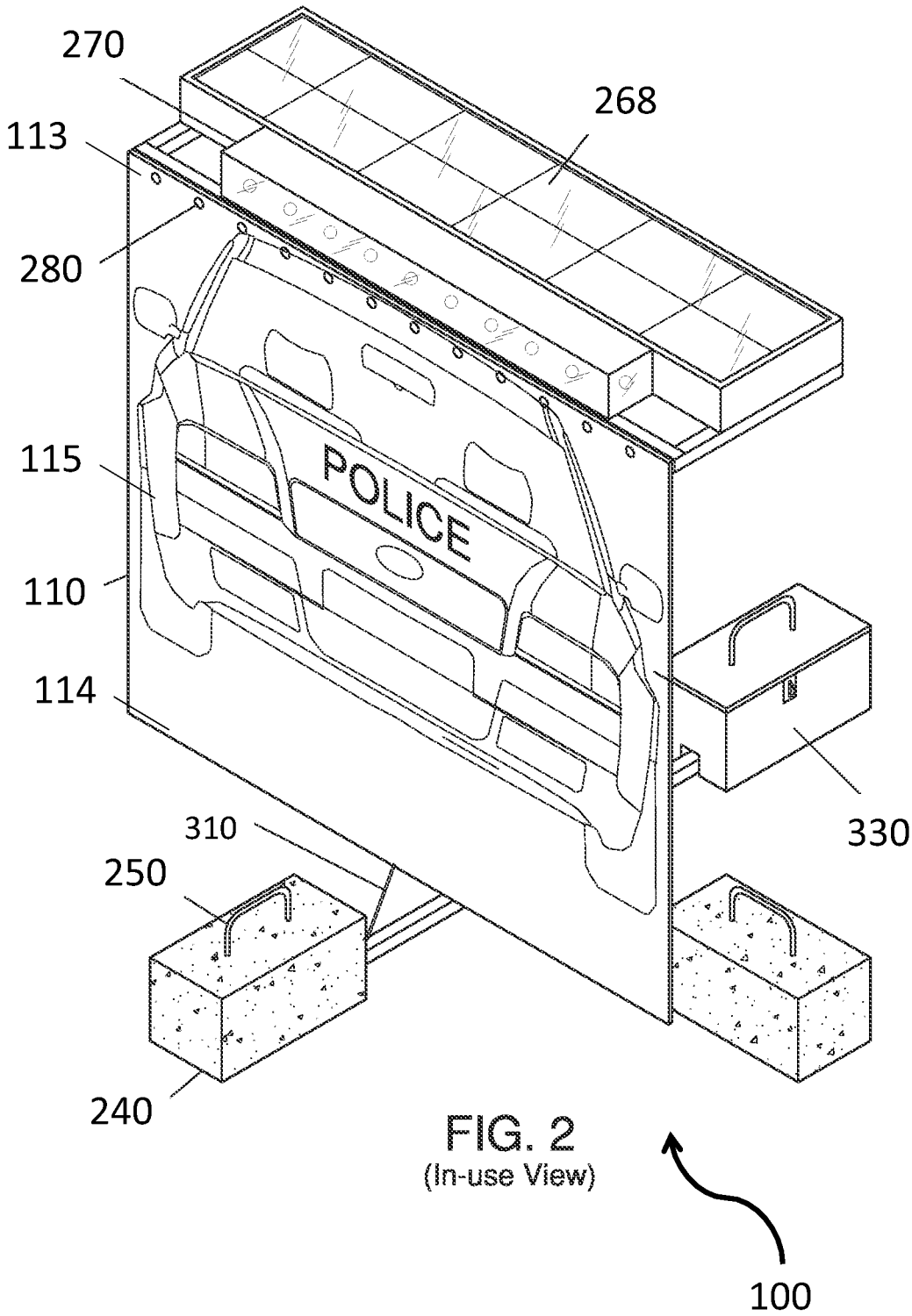
FIG. 2 is an in-use view of the system of the present invention.
Figure 5:
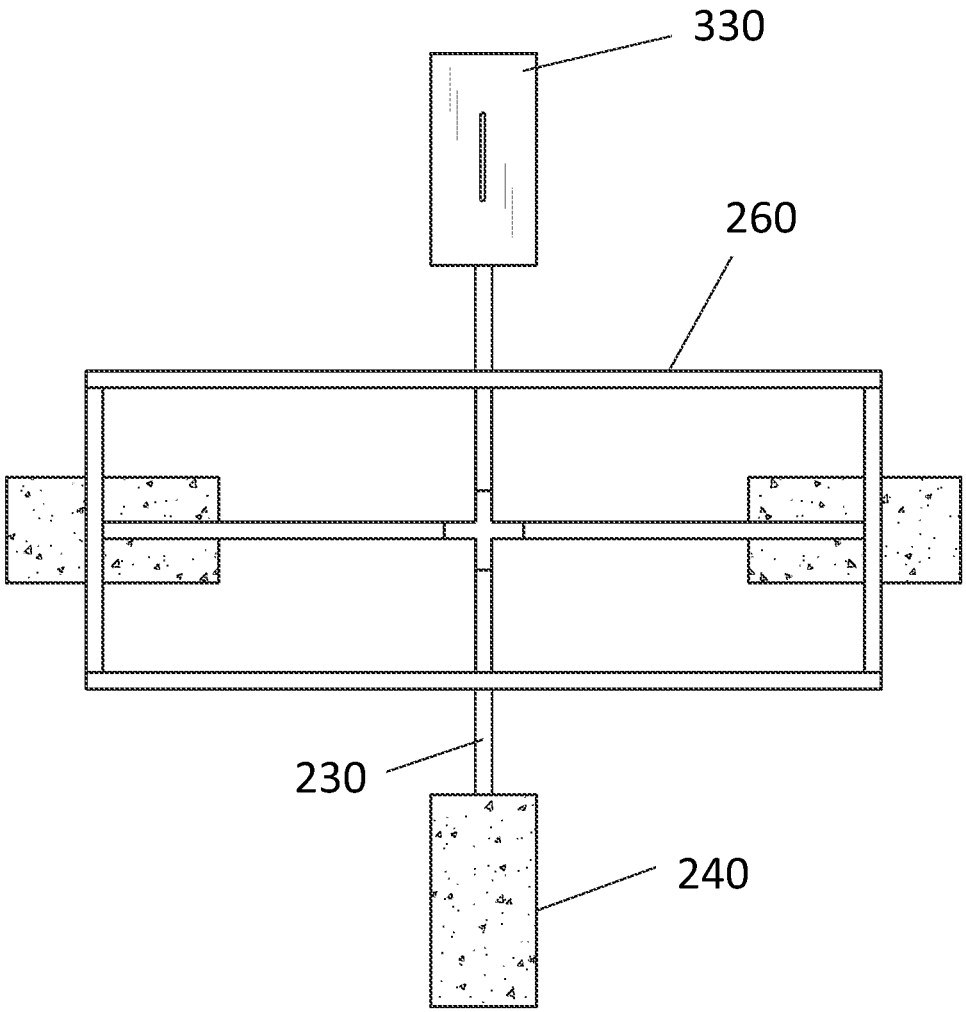
FIG. 5 is a top view of the system of the present invention.

As shown in FIG. 2, in some embodiments, the system 100 comprises a securing means for securing the display panel 110. The securing means is attached to the display panel 110, for example the bottom edge 114 of the display panel 110. The securing means is further attached to one or more legs 230. In some embodiments, the securing means comprises tie downs 310 (e.g., a tie mechanism). In some embodiments, the securing means comprises a chain mechanism, a bungee mechanism, a clasp mechanism, a clip mechanism, a hook mechanism, the like, or a combination thereof. In some embodiments, the securing means is removably attached to the display panel 110. In some embodiments, the securing means is removably attached to the leg 230.

In some embodiments, a battery compartment 330 is disposed in a ballast 240 (e.g., a ballast 240 functions as a battery case). A battery 338 (e.g., 12 volt battery) is housed in the battery compartment 330. The battery 338 is operatively connected to the solar panels 268 (e.g., via wiring 340). The battery 228 is operatively connected to the light component 270 (e.g., via wiring 340). The battery 338 is charged by the solar panels 268. The battery 338 supplies power to the light component 270.

Figure 7:
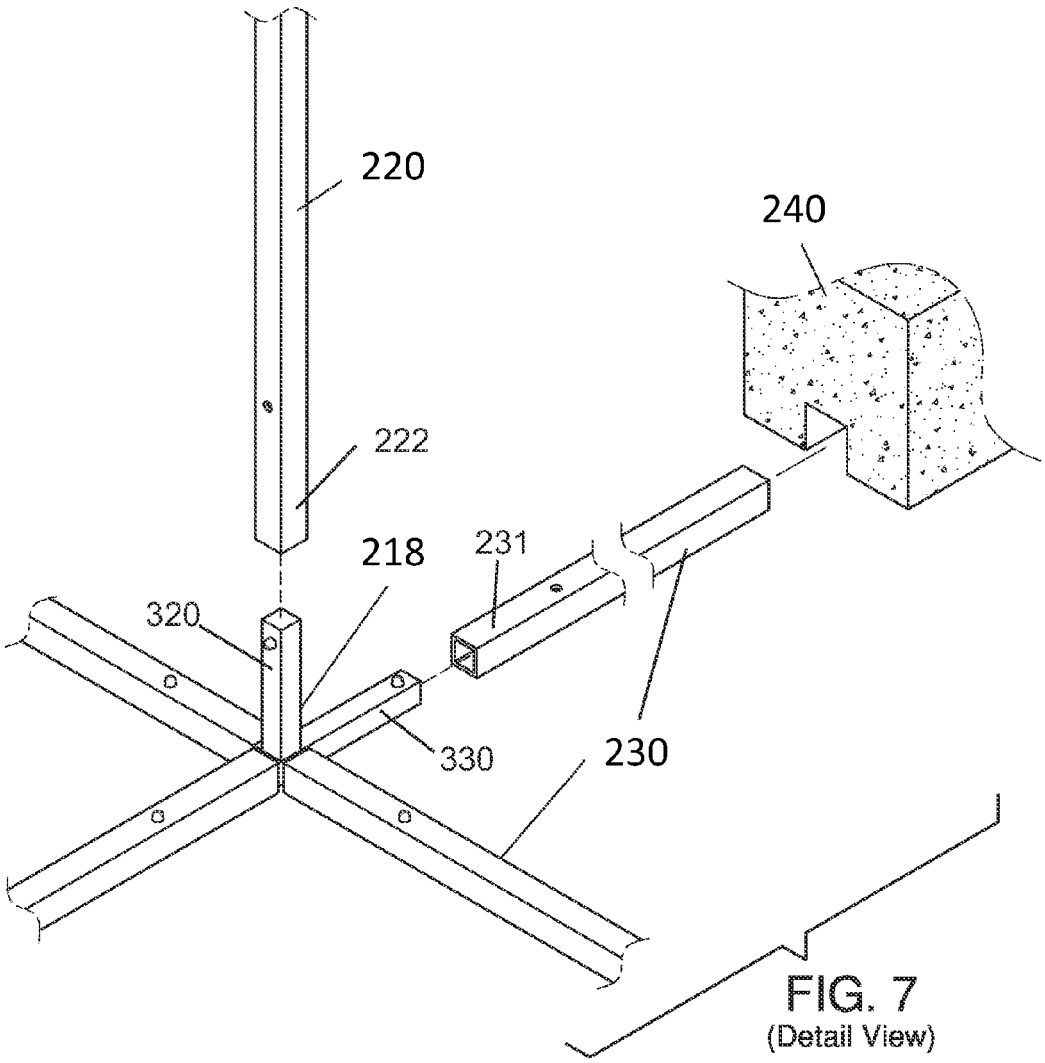
FIG. 7 is a detailed view of the system of the present invention.

As shown in FIG. 7, in some embodiments, the legs 230 are removably attached to the vertical shaft 220. In some embodiments, the ballasts 240 are removably attached to the legs 230. In some embodiments, the base 210 comprises a support component 218 to which the legs 230 and vertical shaft 220 attach. The support component 218 comprises a vertical connector (320) and a plurality of leg connectors (330), wherein the vertical (320) is orthogonal to the leg connectors (330), wherein the vertical connector (320) is removably connected to the second end (222) of the vertical shaft (220), wherein each leg connector (330) is removably connected to the shaft end (231) of each leg (230).

In some embodiments, the system 100 further comprises a securing mechanism for securing all or a portion of the components of the system 100 together (e.g., to prevent theft). As shown in FIG. 1, in some embodiments, the securing mechanism comprises one or more cable locks 360. The securing mechanism is not limited to cable locks 360. Cable locks are well known to one of ordinary skill in the art.

In some embodiments, the system 100 comprises a power switch for turning the light component 270 on and off.

Optionally, other types of energy may be used in lieu of solar energy. For example, in some embodiments, the battery is operatively connected to a wind harnessing system or a hydroelectric system.

The system 100 of the present invention is not limited to the details described herein. For example, in some embodiments, the system 100 encompasses the display 110 without the solar panels and the lights. In some embodiments, the system 100 encompasses the display 110, lights, the vertical shaft 220, legs, and ballasts, but lacks solar panels.

The disclosures of the following U.S. Patents are incorporated in their entirety by reference herein: U.S. Pat. Application No. 2009/0237271; U.S. Pat. Application No. 2008/0197668; U.S. Pat. No. 6,422,714.

EXAMPLE 1

Example 1 describes the combination of the system 100 of the present invention with a speed monitoring trailer. Example 1 serves only as an example and is not limiting in any way.

The system 100, for example the display 110 and the light component 270, is activated and used as described herein. A group of policemen are responsible for operating a speed monitoring trailer in a 55 mph zone. The policemen first detect and record the speed of the traffic in the area with the use of the display 110 and light component 270 of the system 100 of the present invention. The policemen detect that the average speed of the vehicles passing through the 55 mph zone is 53 mph. The policemen then detect and record the speed of the traffic in the same area without the use of the system 100 of the present invention. The policemen detect that the average speed of the vehicles passing through the 55 mph zone is 62 mph.

EXAMPLE 2

Example 2 describes alternative embodiments and alternative uses for the system 100 of the present invention. The present invention also features devices that appear to be police cars with no lighting or solar panels, for example a sign with a permanently mounted base similar to what some police departments use for various types of traffic control such as the radar speed displays that are common everywhere. The device may be a supplement to enhance the effectiveness of the equipment currently being used. An alternative version of the device may be fabricated so someone could hold it, such as a flagger on highway construction projects that would operate with a small lawn tractor battery that would have to be charged when taken back to a shop during non construction hours. Whenever a flagger could see oncoming traffic he/she could activate the emergency light bar to slow down traffic. An alternative version of this device may be a cutout (e.g., plywood) in the shape of and painted like a police car mounted to permanent posts located in areas where there is trouble with transient traffic. The transient traffic would see it and not realize it is a decoy and slow down inadvertently slowing down local traffic that is aware that it is a decoy. It could also be enhanced by attaching red and blue reflectors to resemble the emergency light bar especially at night when headlights are shining on it. The banner could also be painted in 3 dimensional to resemble a police car. The devise could also be fabricated with an inflatable balloon in the shape of a police car, similar to what car dealerships use as advertising.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A traffic safety system (100) comprising:

(a) a display panel (110) having a top edge (113), wherein a picture of a police car (117) is disposed on a front surface (115) of the display panel (110); wherein the picture of police car (117) shows a roof (118) that is positioned adjacent to the top edge (113) of the display panel;

(b) a base (210) comprising a vertical shaft (220) having a first end (221) and a second end (222), and at least four legs (230) extending outwardly from the second end (222) of the vertical shaft (220);

(c) a first ballast (241), a second ballast (242), a third ballast (243), and a fourth ballast (244) herein collectively referred to as a ballast (240), wherein each ballast (240) comprises a groove (245) disposed on an underside of the ballast (240), wherein each ballast (240) is disposed on a free end (232) of one of the legs (230), wherein the free end (232) of each leg (230) fits into the groove (245) of the ballast (240) to hold the leg in place, wherein the ballasts (240) function to provide weight and stability, wherein each leg (230) has a shaft end (231) and a free end (232) that extends away from the shaft (220), wherein the legs (230) are removably attached to the vertical shaft (220) via a support component (218) comprising a vertical connector (320) and a plurality of leg connectors (330), wherein the vertical connector (320) is orthogonal to the leg connectors (330), wherein the vertical connector (320) is removably connected to the second end (222) of the vertical shaft (220), wherein each leg connector (330) is removably connected to the shaft end (231) of each leg (230);

(d) a frame (260) disposed on the first end (221) of the vertical shaft (220), the frame (260) is adapted to hold a solar panel (268), wherein the top edge (113) of the display panel (110) is attached to a first side edge (261) of the frame (260) via a first attachment means, wherein the solar panel (268) is disposed flat on the frame (260);

(e) a light component (270) disposed on the frame (260) adjacently above the display panel (110) such that the light component (270) is positioned just above the roof (118) of the police car (117) picture, the light component (270) comprises at least one light which simulates a standard police car lights;

(f) a securing means attached to a bottom edge (114) of the display panel (110) and to at least one leg (230), the securing means helps hold the display (110) in place; and (g) a battery compartment (330) housing a battery (338), the battery (338) is operatively connected to the solar panels (268) and to the light component (270), the battery (338) is charged by the solar panels (268) and supplies power to the light component (270), wherein the battery compartment (330) is disposed in the fourth ballast (244).

2. The system (100) of claim 1, wherein the legs (230) are arranged symmetrically around the vertical shaft (220).

3. The system (100) of claim 1, wherein the ballast (240) weighs about 50 pounds.

4. The system (100) of claim 1, wherein a handle (250) is disposed on one or more ballasts (240).

5. The system (100) of claim 1, wherein the ballasts (240) are removably attached to the legs (230) via a second attachment means.

6. The system (100) of claim 1, wherein the second attachment means comprises a strap mechanism (290), a magnet mechanism, a clamp mechanism, a book mechanism, a tie mechanism, or a combination thereof.

7. The system (100) of claim 1, wherein the first attachment means comprises a snap mechanism (280), a button mechanism, a magnet mechanism, a clamp mechanism, a clasp mechanism, a hook-and-loop fastener mechanism, a clip mechanism, a hook mechanism, a tie mechanism, or a combination thereof.

8. The system (100) of claim 1, wherein the light component (270) comprises lights of two or more colors.

9. The system (100) of claim 1, wherein the securing means comprises a tie mechanism, a chain mechanism, a bungee mechanism, a clasp mechanism, a clip mechanism, a hook mechanism, or a combination thereof.

10. The system (100) of claim 1 further comprising a securing mechanism for securing at least the vertical shaft (220) and the frame (260) together.

11. The system (100) of claim 10, wherein the securing mechanism comprises a cable lock (360).

12. The system (100) of claim 1, wherein the display panel (110) is constructed from a material comprising vinyl.

13. The system (100) of claim 1, wherein the display panel (110) comprises reflectors.

14. A traffic safety system (100) consisting of:

(a) a display panel (110) having a top edge (113), wherein a picture of a police car (117) is disposed on a front surface (115) of the display panel (110); wherein the picture of police car (117) shows a roof (118) that is positioned adjacent to the top edge (113) of the display panel;

(b) a base (210) consisting of a vertical shaft (220) having a first end (221) and a second end (222), and at least four legs (230) extending outwardly from the second end (222) of the vertical shaft (220);

(c) a first ballast (241), a second ballast (242), a third ballast (243), and a fourth ballast (244), herein collectively referred to as a ballast (240), wherein each ballast (240) consists of a groove (245) disposed on an underside of the ballast (240), wherein each ballast (240) is disposed on a free end (232) of one of the legs (230), wherein the free end (232) of each leg (230) fits into the groove (245) of the ballast (240) to hold the leg in place, wherein the ballasts (240) function to provide weight and stability, wherein each leg (230) has a shaft end (231) and a free end (232) that extends away from the shaft (220), wherein the legs (230) are removably attached to the vertical shaft (220) via a support component (218) consisting of a vertical connector (320) and a plurality of leg connectors (330), wherein the vertical (320) is orthogonal to the leg connectors (330), wherein the vertical connector (320) is removably connected to the second end (222) of the vertical shaft (220), wherein each leg connector (330) is removably connected to the shaft end (231) of each leg (230);

(d) a frame (260) disposed on the first end (221) of the vertical shaft (220), the frame (260) is adapted to hold a solar panel (268), wherein the top edge (113) of the display panel (110) is attached to a first side edge (261) of the frame (260) via a first attachment means, wherein the solar panel (268) is disposed flat on the frame (260);

(e) a light component (270) disposed on the frame (260) adjacently above the display panel (110) such that the light component (270) is positioned just above the roof (118) of the police car (117) picture, the light component (270) consists of at least one light which simulates a standard police car lights;

(f) a securing means attached to a bottom edge (114) of the display panel (110) and to at least one leg (230), the securing means helps hold the display (110) in place; and (g) a battery compartment (330) housing a battery (338), the battery (338) is operatively connected to the solar panels (268) and to the light component (270), the battery (338) is charged by the solar panels (268) and supplies power to the light component (270), wherein the battery compartment (330) is disposed in the ballast (240).

* * * * *